US012146372B2

(12) United States Patent
Hofacker

(10) Patent No.: US 12,146,372 B2
(45) Date of Patent: Nov. 19, 2024

(54) SYSTEM AND METHOD FOR ACTIVE CENTRALIZATION OF DOWNHOLE WELL TOOLS

(71) Applicant: SCHLUMBERGER TECHNOLOGY CORPORATION, Sugar Land, TX (US)

(72) Inventor: Mark Hofacker, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/475,928

(22) Filed: Sep. 27, 2023

(65) Prior Publication Data

US 2024/0018831 A1 Jan. 18, 2024

Related U.S. Application Data

(63) Continuation of application No. 17/651,287, filed on Feb. 16, 2022, now Pat. No. 11,773,660.

(51) Int. Cl.

| | |
|---|---|
| ***E21B 17/10*** | (2006.01) |
| ***E21B 34/06*** | (2006.01) |
| ***E21B 47/003*** | (2012.01) |
| ***E21B 47/06*** | (2012.01) |
| ***E21B 47/09*** | (2012.01) |

(52) U.S. Cl.

CPC ..... *E21B 17/1078* (2013.01); *E21B 17/1014* (2013.01); *E21B 34/06* (2013.01); *E21B 47/003* (2020.05); *E21B 47/06* (2013.01); *E21B 47/09* (2013.01)

(58) Field of Classification Search

CPC .. E21B 17/1014; E21B 17/1078; E21B 17/10; E21B 34/06; E21B 47/003; E21B 47/06; E21B 47/09

See application file for complete search history.

(56) References Cited

U.S. PATENT DOCUMENTS

| | | | | |
|---|---|---|---|---|
| 2003/0173076 | A1 | 9/2003 | Sheiretov | |
| 2004/0011525 | A1* | 1/2004 | Jones | E21B 49/008 166/264 |
| 2008/0115575 | A1* | 5/2008 | Meek | E21B 49/10 73/152.24 |
| 2012/0131996 | A1 | 5/2012 | Anish | |
| 2013/0081803 | A1* | 4/2013 | Tao | E21B 17/1014 166/55.2 |
| 2018/0003850 | A1 | 1/2018 | Jaaskelainen | |
| 2019/0063214 | A1* | 2/2019 | Castillo | E21B 17/1057 |

(Continued)

OTHER PUBLICATIONS

International Search Report and Written Opinion issued in International Patent application PCT/US2023/013074 dated Jun. 2, 2023 , 11 pages.

(Continued)

*Primary Examiner* — George S Gray

(74) *Attorney, Agent, or Firm* — Jeffrey D. Frantz

(57) ABSTRACT

A technique facilitates control over the positioning of a well tool in a wellbore or other type of borehole. A well tool is combined with a centralizer system. The centralizer system has a plurality of extension members which are oriented to extend outwardly from the well tool. The extension members of the plurality of extension members are controllable to enable controlled positioning of the well tool within the borehole.

19 Claims, 3 Drawing Sheets

(56) References Cited

U.S. PATENT DOCUMENTS

| | | | | |
|---|---|---|---|---|
| 2019/0301258 | A1 | 10/2019 | Li | |
| 2019/0383108 | A1* | 12/2019 | Massey | E21B 17/1057 |
| 2021/0062585 | A1 | 3/2021 | Nanayakkara | |

OTHER PUBLICATIONS

Office Action issued in U.S. Appl. No. 17/651,287 dated Jan. 31, 2023, 16 pages.
Office Action (Interview Summary) issued in U.S. Appl. No. 17/651,287 dated dated Apr. 5, 2023, 6 pages.

* cited by examiner

SYSTEM AND METHOD FOR ACTIVE CENTRALIZATION OF DOWNHOLE WELL TOOLS

CROSS-REFERENCE TO RELATED APPLICATIONS

The present application is a continuation of, and claims benefit of, U.S. patent application Ser. No. 17/651,287, entitled "SYSTEM AND METHOD FOR ACTIVE CENTRALIZATION OF DOWNHOLE WELL TOOLS", filed on Feb. 16, 2022, which is incorporated herein by reference in its entirety.

BACKGROUND

In many well applications, various well tools are deployed downhole into a borehole, e.g., a wellbore. A given well tool may be part of an overall well string conveyed downhole to a desired location in the borehole so as to enable performance of a desired downhole operation. In some downhole operations, the position of the well tool within the borehole can affect the function of the well tool. For example, fishing operations and certain other downhole operations benefit from proper positioning, e.g., centralizing, of the well tool within the borehole. Centralizing a fishing tool facilitates engagement of the fishing tool with the equipment to be fished, i.e., pulled from the wellbore. With the existing well tools, however, the ability to control positioning of the well tool is limited.

SUMMARY

In general, a system and methodology facilitate control over the positioning of a well tool in a wellbore or other type of borehole. According to an embodiment, a system comprises a well tool combined with a centralizer system. The centralizer system has a plurality of extension members which are oriented to extend outwardly, e.g., radially outwardly, from the well tool. The extension members of the plurality of extension members are uniquely controllable to enable controlled positioning of the well tool within the borehole. For example, the extension members may be actuated to centralize the well tool along a desired borehole axis.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate control over the positioning of a well tool in a wellbore or other type of borehole. According to an embodiment, a well system comprises a well tool combined with a centralizer system. The centralizer system is an actively controlled centralizer system having a plurality of extension members which are oriented to extend outwardly, e.g., radially outwardly, from the well tool. The extension members of the plurality of extension members are uniquely controllable to enable controlled positioning of the well tool within the borehole. For example, the extension members may be actuated to centralize the well tool along a desired borehole axis.

The ability to control the lateral movement of the well tool in a borehole, e.g., to centralize the well tool along a central borehole axis in the borehole, enables or enhances a number of downhole operations. For example, the ability to control the centralization of the well tool improves fishing operations. In many fishing operations, difficulty arises in securely attaching a fishing tool to lost downhole equipment for recovery. Embodiments described herein utilize the centralizer system to actively and controllably align the fishing tool with the target to improve the success rate of fishing operations. In some applications, the ability to centralize the well tool helps avoid getting the well tool stuck during deployment. This ability to actively centralize also enables the use of larger tools than would normally be usable in certain wells, e.g., wells with constrictions.

Figure 1:
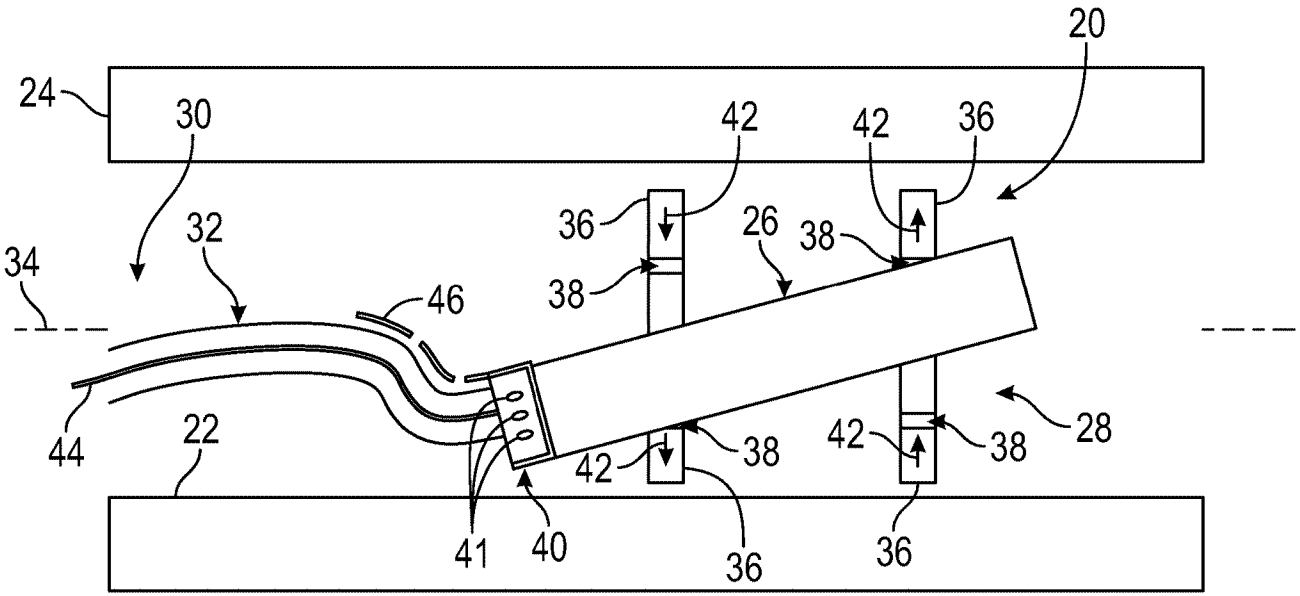
FIG. 1 is a schematic illustration of an example of a well system having a well tool combined with a centralizer system for positioning the well tool at a desired location within a borehole, according to an embodiment of the disclosure.
Figure 2:
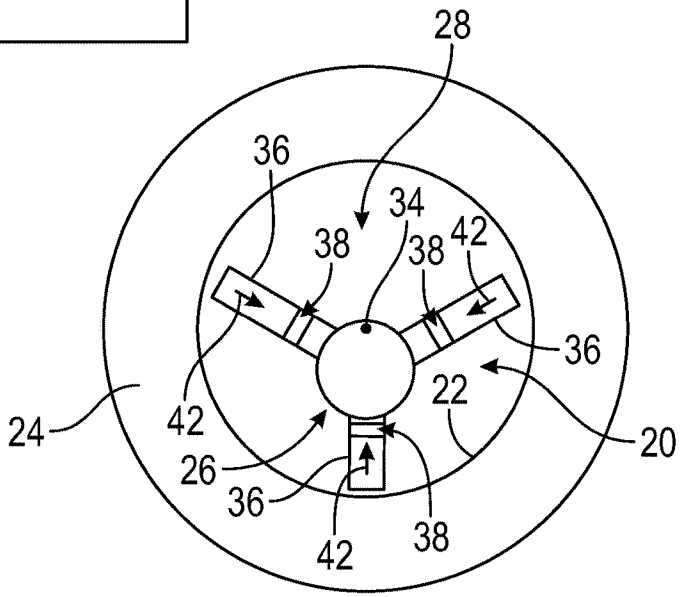
FIG. 2 is a schematic illustration of the well system illustrated in FIG. 1 viewed from a cross-section through the borehole, according to an embodiment of the disclosure.

Referring generally to FIGS. 1 and 2, an example of a well system 20 is illustrated as deployed in a borehole 22, e.g., a wellbore. In this example, the borehole 22 is illustrated as lined with casing 24 although the borehole 22 may be an open hole borehole. According to the example illustrated, the well system 20 comprises a well tool 26 combined with a centralizer system 28. The well tool 26 may be in the form of a fishing tool or a wide variety of other downhole tools selected for use in various downhole operations.

The well system 20 also may comprise a conveyance 30 for deploying the well tool 26 and centralizer system 28 to a desired downhole position in the borehole 22. In the illustrated example, the conveyance 30 is in the form of coiled tubing 32. The centralizer system 28 is helpful in many types of coiled tubing operations because the lateral position of the well tool 26 can be controlled via centralizer system 28 even though the coiled tubing 32 may undergo flexing during movement and/or operation downhole. It should be noted the centralizer system 28 may be actively controlled so as to adjust the lateral position of the well tool 26 within the borehole 22 to a desired location and/or orientation.

In some applications, the desired lateral positioning of the well tool 26 involves centralizing the well tool 26 along a center borehole axis 34. However, the centralizing action of centralizer system 28 also may be used to shift the well tool 26 to other desired axes or positions within the borehole 22. Depending on the construction of centralizer system 28, the system 28 also may be used to orient the well tool 26, e.g., to orient the well tool 26 such that the entire well tool is aligned with a desired axis, e.g., center borehole axis 34 (see FIGS. 3 and 4).

According to an embodiment, the centralizer system 28 may comprise a plurality of extension members 36 which are oriented to extend outwardly, e.g., radially outwardly, from the well tool 26. The extension members 36 are uniquely extensible, e.g., individually extensible, and the extension position of each extension member 36 may be controlled to adjust the position and orientation of the well tool 26 from an undesirable location (see FIGS. 1 and 2) to a desirable location (see FIGS. 3 and 4).

The positioning of the individual extension members 36 may be controlled hydraulically, electrically, or by other suitable power mechanisms. In the specific example illustrated, the positioning of individual extension members 36 is controlled hydraulically. In this type of embodiment, the centralizer system 28 also comprises a plurality of hydraulic pistons 38 coupled with the plurality of extension members 36 to enable the individual control of the extension position of each extension member 36. For example, an individual hydraulic piston 38 may be coupled with a corresponding individual extension member 36.

Figure 3:
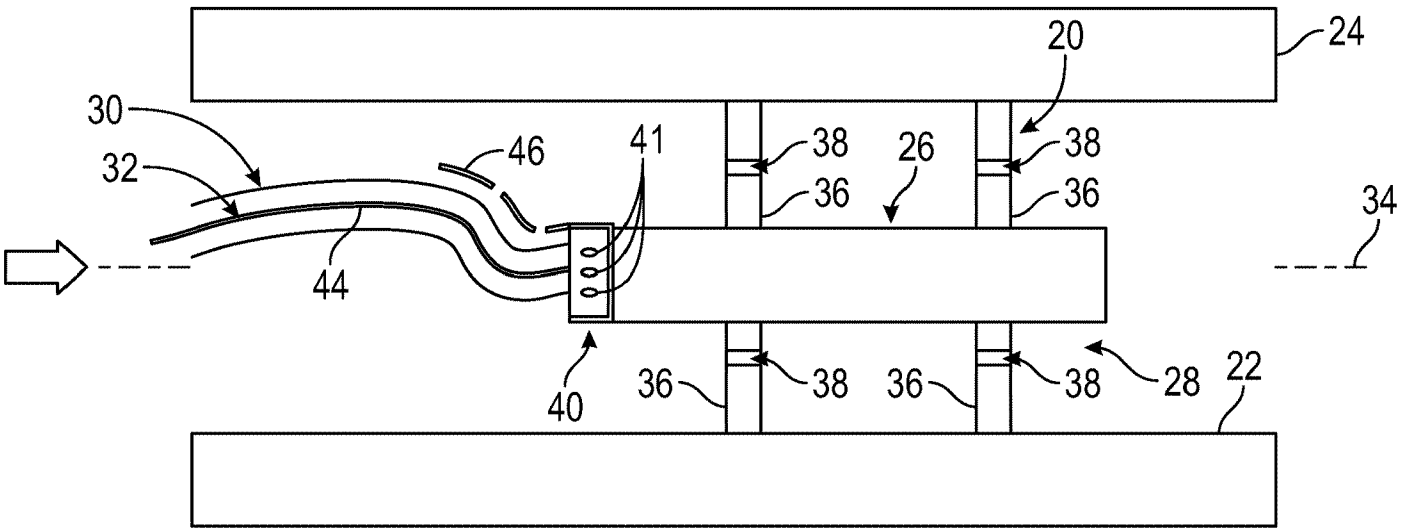
FIG. 3 is a schematic illustration of the well system illustrated in FIG. 1 showing the well tool in a centralized position, according to an embodiment of the disclosure.
Figure 4:
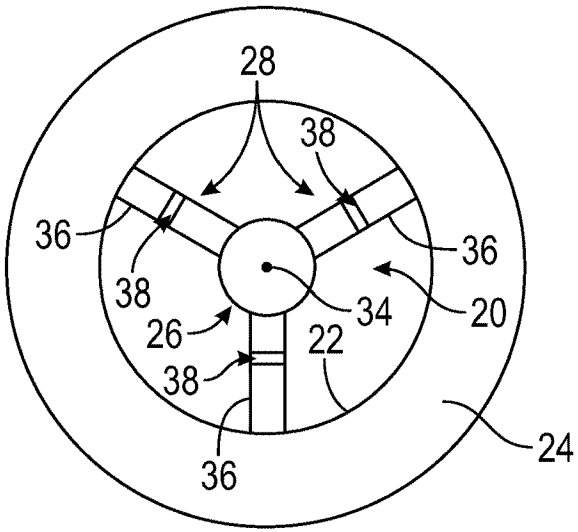
FIG. 4 is a schematic illustration of the well system illustrated in FIG. 3 viewed from a cross-section through the borehole, according to an embodiment of the disclosure.

Flow of hydraulic actuating fluid to the hydraulic pistons 38 may be controlled via a valve system 40 so as to control positioning of the well tool 26 and the borehole 22 via the extension members 36. In some applications, the valve system 40 may comprise a plurality of valves 41. However, valve system 40 also may comprise a single controllable valve 41, such as a multi-position valve, e.g., a three-position valve. The valve(s) 41 of valve system 40 are controllable to meter hydraulic fluid to the plurality of hydraulic pistons 38 individually (or to specific groups of hydraulic pistons 38) so that corresponding extension members 36 may be extended to desired extension positions. In FIGS. 1 and 2, for example, arrows 42 illustrate the use of hydraulic pistons 38 to shift the extension members 36 inwardly and outwardly in a manner which laterally shifts the well tool 26 to a desired position within borehole 22 as illustrated in FIGS. 3 and 4.

In some applications, hydraulic actuating fluid is supplied downhole under sufficient pressure to the valve system 40 via a suitable hydraulic line or lines 44 routed within or externally of coiled tubing 32. However, the hydraulic system can be self-contained and located downhole. For example, the hydraulic system may comprise a downhole pump powered by a downhole motor which receives electrical power via, for example, a downhole battery or via electric control lines routed downhole. The valve system 40 also may be electrically actuated via suitable solenoids or other electric actuators supplied with electrical power via electric control lines 46, a downhole battery, or other power sources. Electric control lines 46, or other suitable control lines, also may be used to communicate control signals for valve system 40 and/or to provide data from downhole. By way of example, the electric control lines 46 or other control lines may be routed within or externally of coiled tubing 32.

In some applications, the valve system 40 may utilize one or more electrically or hydraulically actuated valves operated to control the flow of hydraulic actuating fluid to the desired hydraulic pistons 38. The number of hydraulic pistons 38 and corresponding extension members 36 may vary depending on the overall design of well tool 26 and centralizer system 28. In some applications, three hydraulic pistons 38 may be coupled with three corresponding extension members 36 to form a first set of extension members 36 oriented in three different directions, e.g., spaced 120° from each other as illustrated, so as to enable substantial directional control over the lateral movement of well tool 26 within borehole 22.

If the well tool 26 is relatively long and/or if greater control is desired over the orientation of the well tool 26 an additional set or sets of extension members 36 may be utilized. In the example illustrated, the centralizer system 28 is constructed with a second set of three extension members 36 (with corresponding hydraulic pistons 38) located at a spaced longitudinal distance along well tool 26 relative to the first set of extension members 36. Having multiple sets of extension members 36 acting in different directions provides substantial control over the lateral positioning and orienting of the well tool 26.

In some applications, the valve system 40 may be in the form of a three-way valve which can be operated so as to direct more or less flow of hydraulic fluid to each of the three hydraulic pistons 38 and corresponding extension members 36. In other embodiments, the valve system 40 may comprise a variety of individual valves which may be controlled via electric signal (or other suitable control signal) to provide the desired flow of hydraulic fluid to specific hydraulic pistons. It should be noted that various sensor systems may be combined into the centralizer system 28 to provide feedback regarding the actual position and/or orientation of the well tool 26.

Figure 5:
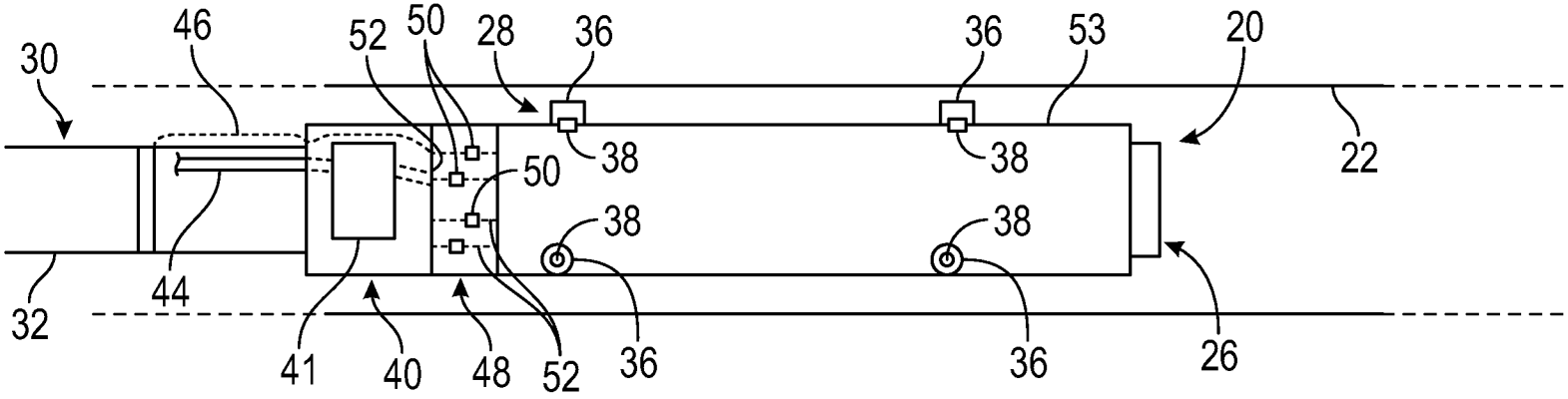
FIG. 5 is a schematic illustration of another embodiment of the well system having a well tool combined with a centralizer system and positioned in a borehole, according to an embodiment of the disclosure.

Referring generally to FIG. 5, an embodiment of well system 20 is illustrated in which the centralizer system 28 comprises both the valve system 40 and a sensor system 48. In this example, sensor system 48 comprises a plurality of sensors 50 which are positioned along hydraulic flowlines 52 extending between valve system 40 and corresponding hydraulic pistons 38. The sensors 50 may be used to monitor position and/or orientation of well tool 26.

The individual sensors 50 may be used to monitor the position of corresponding hydraulic pistons 38 and extension members 36 to, for example, ensure common extension of extension members 36. According to an embodiment, individual sensors 50 may be associated with individual hydraulic pistons 38/extension members 36 or with specific groups of hydraulic pistons 38/extension members 36. In this manner, the sensor system 48 is able to provide feedback to a surface control system and/or operator so as to enable improved control over the positioning of well tool 26. In some embodiments, the sensor system 48 can be configured to provide automatic, real-time feedback to a suitable surface or downhole control system so as to facilitate guidance of the well tool 26 as it moves along the borehole 22 or to laterally position the well tool 26 at a specific location along borehole 22.

By way of example, the sensors 50 may be in the form of pressure sensors positioned to monitor pressure along hydraulic flowlines 52. However, the sensors 50 also may be in the form of fluid volume sensors to monitor the amount of hydraulic actuating fluid delivered to each hydraulic piston 38 (or to specific groups of hydraulic pistons 38). It should be noted that in this embodiment and other embodiments described herein, the pistons 38/extension members 36 may be mounted in a variety of mounting structures 53, e.g., housings, which are secured with well tool 36 via clamping, fasteners, or other suitable attachment mechanisms.

Figure 6:
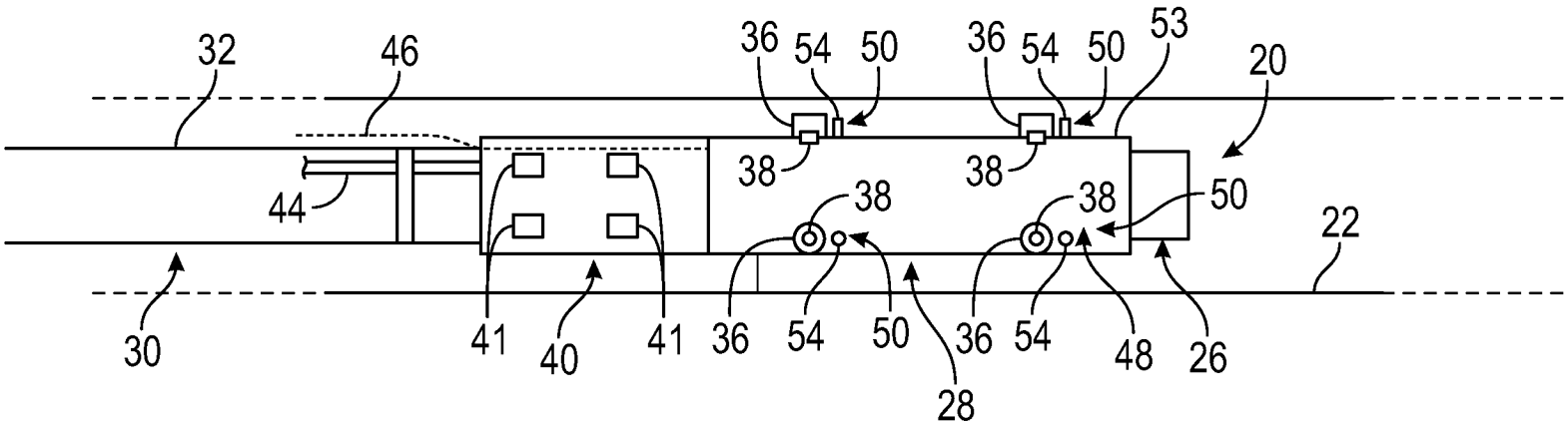
FIG. 6 is a schematic illustration of another embodiment of the well system having a well tool combined with a centralizer system and positioned in a borehole, according to an embodiment of the disclosure.

However, a variety of other types of sensors 50 also may be employed. For example, sensors 50 may be in the form of physical sensors 54 as illustrated in FIG. 6. Physical sensors 54 physically feel or detect the position of well tool 26 and/or the extension of individual extension members 36. One example of a physical sensor 54 is a linear variable differential transformer (LVDT) sensor which is able to convert motion of an object into a corresponding electrical signal so as to provide an indication of position. Such sensors 54 may be mounted to detect the motion of individual extension members 36 and/or to detect movement of the well tool 26 and/or centralizer system 28 with respect to a surrounding borehole wall.

Depending on the parameters of a given environment and/or well string operation, the size and type of the well tool 26 may vary. For example, well tool 26 may be in the form of a fishing tool but many other types of well tools utilized for various operations downhole may benefit from improved lateral control. Similarly, the size, type and configuration of centralizer system 28 also may be selected according to the parameters of a given environment, well tool, or desired downhole operation.

Additionally, the number and type of extension members 36 may vary and may be selected according to the specific operation. For example, one or more sets of three extension members 36 may be arranged to extend from different positions about the well tool 26 as described above. However, other numbers and arrangements of the extension members 36 may be selected for different types of operations. Similarly, different types of hydraulic pistons 38 may be combined with extension members 36. For example, each hydraulic piston 38 may be integrally formed with the corresponding extension member 36 or separate hydraulic pistons 38 may be secured to the corresponding extension members 36.

In some applications, the extension members 36 may be constructed for electric actuation instead of hydraulic actuation. Additionally, the centralizer system 28 may comprise various types of bodies or mounting structures to which the hydraulic pistons 38/extension members 36 are securely mounted for controlled extension and contraction. The configuration of the extension members 36 also may be adjusted for use in different types of wellbores, such as cased wellbores or open hole wellbores.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well tool;

a centralizer system configured to adjust a lateral position of the well tool in a borehole of the well, the centralizer system comprising:

a plurality of extensions extending outwardly from the well tool, wherein the plurality of extensions comprise a first set of extensions and a second set of extensions separated by a longitudinal distance along a length of the well tool;

a plurality of hydraulic pistons coupled with the plurality of extensions, wherein each of the plurality of hydraulic pistons is configured to enable individual control of an extension position of a corresponding extension of the plurality of extensions, and wherein each of the plurality of hydraulic pistons is configured to move coaxially with the corresponding extension; and a valve system controllable to meter hydraulic fluid to the plurality of hydraulic pistons such that a position of the well tool in the borehole is controlled via the plurality of extensions.

2. The system of claim 1, wherein the centralizer system comprises a sensor system configured to detect a position, an orientation, or both, of the well tool in the borehole.

3. The system of claim 2, wherein the sensor system comprises one or more sensors configured to detect respective positions of one or more of the plurality of extensions, one or more of the plurality of hydraulic pistons, or any combination thereof.

4. The system of claim 3, wherein the one or more sensors comprise one or more pressure sensors, one or more volume sensors, or both.

5. The system of claim 3, wherein the one or more sensors comprise one or more physical sensors.

6. A system for use in a well, comprising:

a well tool;

a centralizer system configured to adjust a lateral position of the well tool in a borehole of the well, the centralizer system comprising:

a plurality of electrically-activated extensions extending outwardly from the well tool; and a plurality of sensors, wherein each sensor of the plurality of sensors is configured to detect a respective position of a respective electrically-activated extension of the plurality of electrically-activated extensions; and a control system configured to:

receive one or more feedback signals from the plurality of sensors indicative of at least one of the respective positions of the plurality of electrically-activated extensions; and transmit one or more control signals to the centralizer system to adjust the lateral position of the well tool.

7. The system of claim 6, wherein the control system is communicatively coupled to the centralizer system via one or more electric control lines.

8. The system of claim 7, further comprising coiled tubing, and wherein the coiled tubing comprises the one or more electric control lines.

9. The system of claim 6, wherein the control system is configured to monitor the lateral position of the well tool in the borehole.

10. The system of claim 6, wherein the plurality of sensors comprise one or more physical sensors.

11. The system of claim 6, wherein the plurality of sensors comprise one or more linear variable differential transformer (LVDT) sensors.

12. The system of claim 6, wherein the plurality of electrically-activated extensions comprise a first set of extensions and a second set of extensions separated by a longitudinal distance along a length of the well tool.

13. A system for use in a well, comprising:

a well tool;

a centralizer system configured to adjust a lateral position of the well tool in a borehole of the well, the centralizer system comprising:

a plurality of electrically-activated extensions extending outwardly from the well tool, wherein the plurality of electrically-activated extensions comprise a first set of extensions and a second set of extensions separated by a longitudinal distance along a length of the well tool; and a plurality of sensors, wherein each sensor of the plurality of sensors is configured to detect a respective position of a respective electrically-activated extension of the plurality of electrically-activated extensions; and a control system configured to:

receive one or more feedback signals indicative of at least one of the respective positions of the plurality of electrically-activated extensions; and transmit one or more control signals to the centralizer system to adjust the lateral position of the well tool.

14. The system of claim 13, wherein the control system is communicatively coupled to the centralizer system via one or more electric control lines.

15. The system of claim 14, further comprising coiled tubing, and wherein the coiled tubing comprises the one or more electric control lines.

16. The system of claim 13, wherein the control system is configured to monitor the lateral position of the well tool in the borehole.

17. The system of claim 13, wherein the plurality of sensors comprise one or more sensors configured to detect a position of the well tool, the centralizer system, or both, in the borehole.

18. The system of claim 13, wherein the plurality of sensors comprise one or more physical sensors.

19. The system of claim 13, wherein the plurality of sensors comprise one or more linear variable differential transformer (LVDT) sensors.

* * * * *